US010576357B2

(12) United States Patent
Pembridge

(10) Patent No.: US 10,576,357 B2
(45) Date of Patent: Mar. 3, 2020

(54) BINDINGLESS SNOWBOARD

(71) Applicant: Christopher Donald Pembridge, Jamestown, NY (US)

(72) Inventor: Christopher Donald Pembridge, Jamestown, NY (US)

( * ) Notice: Subject to any disclaimer, the term of this patent is extended or adjusted under 35 U.S.C. 154(b) by 0 days.

(21) Appl. No.: 15/956,117

(22) Filed: Apr. 18, 2018

(65) Prior Publication Data

US 2018/0296901 A1 Oct. 18, 2018

Related U.S. Application Data

(60) Provisional application No. 62/486,543, filed on Apr. 18, 2017.

(51) Int. Cl.

| | |
|---|---|
| ***A63C 5/00*** | (2006.01) |
| ***A63C 5/03*** | (2006.01) |
| ***A63C 5/048*** | (2006.01) |
| ***A63C 10/00*** | (2012.01) |

(52) U.S. Cl.
CPC ..... *A63C 5/03* (2013.01); *A63C 5/0485* (2013.01); *A63C 10/005* (2013.01); *A63C 2203/00* (2013.01)

(58) Field of Classification Search
CPC .. A63C 5/08; A63C 5/003; A63C 5/12; A63C 5/048; A63C 5/03
See application file for complete search history.

(56) References Cited

U.S. PATENT DOCUMENTS

| | | | | |
|---|---|---|---|---|
| 3,343,847 | A | 9/1967 | Christy | |
| 4,848,781 | A | 7/1989 | Dykema et al. | |
| 5,083,810 | A | 1/1992 | Minidis | |
| 5,135,249 | A | 8/1992 | Morris | |
| 5,462,304 | A | 10/1995 | Nyman | |
| 5,580,078 | A | 12/1996 | Vance | |
| 5,891,224 | A * | 4/1999 | Aoyama | C08K 5/42 106/2 |

(Continued)

FOREIGN PATENT DOCUMENTS

GB 2544319 5/2017

*Primary Examiner* — Hau V Phan
(74) *Attorney, Agent, or Firm* — Simpson & Simpson, PLLC

(57) ABSTRACT

A bindingless snowboard including: a deck having a platform, the platform includes a first deck side edge, a second deck side edge, an upper deck surface and a lower deck surface; a first extension secured to and extending from the first deck side edge; a second extension secured to and extending from the second deck side edge; a base having a first base side edge and a second base side edge, the base secured to the lower deck surface; a first carving edge secured to the first deck edge; a second carving edge secure to the second deck edge; a first sidewall spacer secured between the first extension and the first edge and positioned adjacent to the first deck side edge; and, a second sidewall spacer secured between the second extension and the second edge and positioned adjacent to the second deck side edge, wherein at least a portion of a first force applied to the first extension is transmitted to the first carving edge through the first sidewall spacer and at least a portion of a second force applied to the second extension is transmitted to the second carving edge through the second sidewall spacer.

18 Claims, 6 Drawing Sheets

(56) References Cited

U.S. PATENT DOCUMENTS

| | | | | |
|---|---|---|---|---|
| 6,193,244 | B1 * | 2/2001 | Vance | A63C 5/03 280/14.22 |
| 6,217,041 | B1 * | 4/2001 | Hauser | A63C 5/03 280/14.21 |
| D448,441 | S | 9/2001 | Wolf | |
| 6,293,567 | B1 * | 9/2001 | Menges | A63C 5/03 280/14.21 |
| 6,910,695 | B2 | 6/2005 | Ellington | |
| 7,073,810 | B2 | 7/2006 | Wilson | |
| 7,111,864 | B2 * | 9/2006 | Molg | A63C 5/003 280/608 |
| 7,275,756 | B2 * | 10/2007 | Turner | A63C 5/12 280/610 |
| 8,246,070 | B2 * | 8/2012 | Lin | A63C 5/03 280/11.14 |
| 8,632,079 | B2 | 1/2014 | Ryan | |
| 9,308,432 | B1 | 4/2016 | Olson | |
| 2002/0158430 | A1 | 10/2002 | Farcot et al. | |
| 2003/0151215 | A1 | 8/2003 | Stief et al. | |
| 2004/0032113 | A1 | 2/2004 | Rancon et al. | |
| 2004/0262884 | A1 | 12/2004 | Langford et al. | |

* cited by examiner

BINDINGLESS SNOWBOARD

CROSS-REFERENCE TO RELATED APPLICATIONS

This patent application claims the benefit under 35 U.S.C. § 119(e) of U.S. Provisional Patent Application No. 62/486,543, filed Apr. 18, 2017, which application is incorporated herein by reference.

FIELD

The present invention relates to snowboards, and, more particularly, to a bindingless snowboard designed to give riders the function of bindings without being tethered to the board.

BACKGROUND

Similar to other board sports, the origin of snowboarding comes from surfing. The desire to stand up and ride waves sideways has existed for hundreds of years. It was a central part of the ancient Polynesian culture on the Hawaiian Islands and from there it has spread to beaches all around the world. The appeal of surfing in part comes from the thrill and associated adrenaline rush a rider gets when they master the environment. Skill and balance are required to successfully carve ocean waves.

Carving is the core of all board sports. It is how a rider navigates the terrain and controls their speed. Besides standing up, it is the first thing a boarder learns how to do. It typically involves shifting balance to the toes or heels to move the board in the desired direction. The act of doing this is fairly consistent across all board sports but the equipment plays a major role in performing a successful carve on the respective terrain. Board riders have found a way to carve nearly every terrain imaginable and there is a wide variety of equipment that caters to a rider's individual style.

Surfing for instance has spawned dozens of subcategories that all involve riding the water. Stand-up paddle surfing for example involves a rider using a long paddle to propel themselves in flat water. This means they no longer need to lie down on the board and use their arms to move when there is not a breaking wave to carry them. Another popular water-surfing sport is wake-boarding. A rider is strapped into a board and is towed behind a motor boat. This concept has dual origins as it is also largely influenced by water-skiing.

A similar history exists for snowboarding. In the 1960's, a handful of surfers looked at the snow-covered mountains and saw the potential to surf new terrain. Since skiing already existed and was a fairly developed activity, the groundwork for how someone might "surf" the snow was generally defined. The incline of the mountain provided momentum and the deep snow could be carved very similarly to the way a surfboard carves water. From there it was a matter of developing the equipment and pushing the limits of what a snowboard could be.

Snowboard designs have changed greatly in the past forty to fifty years. What started out as clumsy plank of plywood has evolved into a highly sophisticated and lightweight board. A major development in snowboarding came with the incorporation of bindings. Board designers believed it was necessary for a rider to be strapped to the board in order to have proper control and stability while riding. Additionally, snowboards began using metal edges around the base to permit carving in snow conditions other than powder. This addition made snowboarding viable on hard packed snow and even icy terrain.

The most common form of snowboarding, similar to skiing, occurs at ski resorts. A rider wears special boots which are designed to fit into bindings that are mounted to the snowboard. To move around when gravity or momentum is not assisting, the back foot is removed from the binding and used to push against the snow to propel the rider forward. A ski lift is typically used to ascend the terrain, and upon reaching the end of the lift, the rider re-connects their back foot into the binding. With both feet secured to the board, the rider descends the slope, carving back and forth in the snow maximize their experience and to control their speed and position.

At the onset, snowboarding can be an intimidating sport. The equipment is expensive, the learning curve is steep, and riders are limited as to where they can effectively ride with a traditional board configuration. The foregoing are major deterrents for people looking to enter the sport as well as being some of the main reasons riders abandon snowboarding as a winter activity. Much like in surfing and skateboarding, people have different intentions and preferences in how they ride. Some are more casual, some seek a greater thrill or adrenaline release, while still others want to master different tricks and maneuvers. Beginners typically prefer a smooth, comfortable and safe learning experience. Experienced riders typically want to try something new and/or different to revitalize their love of the sport. One option includes providing a variety of equipment that caters to an individual's needs. This option is something that the surfing and skateboarding communities do very well. Snowboarding on the other hand falls short of providing the amount of options as its concrete and water-riding counterparts.

Therefore, there is a need for alternate snowboard configurations that provide riders control and stability while maintaining or reinvigorating the riders' love of the sport, e.g., a snowboard that does not require a secured connection between the rider and the board.

SUMMARY

According to aspects illustrated herein, there is provided a bindingless snowboard including: a deck having a platform, the platform includes a first deck side edge, a second deck side edge, an upper deck surface and a lower deck surface; a first extension secured to and extending from the first deck side edge; a second extension secured to and extending from the second deck side edge; a base having a first base side edge and a second base side edge, the base secured to the lower deck surface; a first carving edge secured to the first deck edge; a second carving edge secure to the second deck edge; a first sidewall spacer secured between the first extension and the first edge and positioned adjacent to the first deck side edge; and, a second sidewall spacer secured between the second extension and the second edge and positioned adjacent to the second deck side edge, wherein at least a portion of a first force applied to the first extension is transmitted to the first carving edge through the first sidewall spacer and at least a portion of a second force applied to the second extension is transmitted to the second carving edge through the second sidewall spacer.

According to aspects illustrated herein, there is provided a bindingless snowboard including: a deck having a platform, the platform includes a first deck side edge, a second deck side edge, an upper deck surface and a lower deck surface; a first extension having a first end adjacent to the first deck side edge, a second end opposite the first end and a first carving edge secured to the second end, the first extension being secured to and extending elevationally upward from the first deck side edge; a second extension having a first end adjacent to the second deck side edge, a second end opposite the first end and a second carving edge secured to the second end, the second extension being secured to and extending elevationally upward from the second deck side edge; a base having a first base side edge and a second base side edge, the base secured to the lower deck surface; a third carving edge secured to the first deck edge; and, a fourth carving edge secure to the second deck edge, wherein at least a portion of a first force applied to the first extension is transmitted to the first carving edge and at least a portion of a second force applied to the second extension is transmitted to the second carving edge.

According to aspects illustrated herein, there is provided a bindingless snowboard including: a deck having a platform, the platform includes a first deck side edge, a second deck side edge, an upper deck surface and a lower deck surface; a first extension secured to and extending from the first deck side edge; a second extension secured to and extending from the second deck side edge; a base having a first base side edge and a second base side edge, the base secured to the lower deck surface; a first carving edge secured to the first deck edge; and, a second carving edge secure to the second deck edge, wherein at least a portion of a first force applied to the first extension is transmitted to the first carving edge and at least a portion of a second force applied to the second extension is transmitted to the second carving edge.

According to aspects illustrated herein, there is provided a bindingless snowboard designed to give a rider maximum freedom when riding. In some embodiments, the present contour system replaces the function that bindings typically provide to a board. By including a valley for orienting a rider's feet, the rider can remain located in the ideal position on the board without slipping off or about the board. In some embodiments, the valley may be lined with textured ethylene vinyl acetate (EVA) foam, or other appropriate materials as discussed infra. In these embodiments, the foam provides a waterproof grip and superior riding comfort. Additionally, the present contour system provides a rider with the necessary leverage to initiate turns in both the heel and toe directions. By elevating the heels and toes above the effective edge as well as extending them laterally past the edges, the presently disclosed bindingless snowboard creates responsiveness beyond that provided by a traditional binding. In some embodiments, ultra-dense vinyl nitrile (VN) foam lines the angled surfaces where the toes and heels are positioned to help preserve board responsiveness. This arrangement provides better gripping force than grip tape when wet and will not fill in with snow. In some embodiments, the presently disclosed bindingless snowboard also features a dual edge system, wherein interior edges sit lower and act as a first means for carving, and when a rider leans at a greater angle for a more aggressive turn, outer edges engage providing a second means for carving a different radius turn.

The core of the bindingless snowboard is made from four layers of bamboo veneer sandwiched between two layers of fiberglass and epoxy resin. Wood core construction is standard in traditional snowboards as it provides the ideal flex and strength. Fiberglass and resin keep the bindingless snowboard board waterproof which greatly increases the longevity of the board. The base of the bindingless snowboard includes P-TEX® (sintered high density polyethylene), which is the industry standard for skis and snowboards. Wax may be applied to the base which promotes sliding between the snowboard and snow. In some embodiments, the interior and exterior edges are made of steel, similar to other skis and snowboards. Steel edges provide excellent grip and facilitate caring, even on icy terrain.

The bindingless snowboard is a board that can be used by riders of all skill levels, from beginners to long time veterans. For beginners, it offers a smoother learning experience than traditional snowboards. Awkward falls without any way to catch yourself on the way down is minimized by having your feet free from bindings. For advanced riders, the presently disclosed snowboard is a fresh way to approach riding that opens up new style and terrain possibilities.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
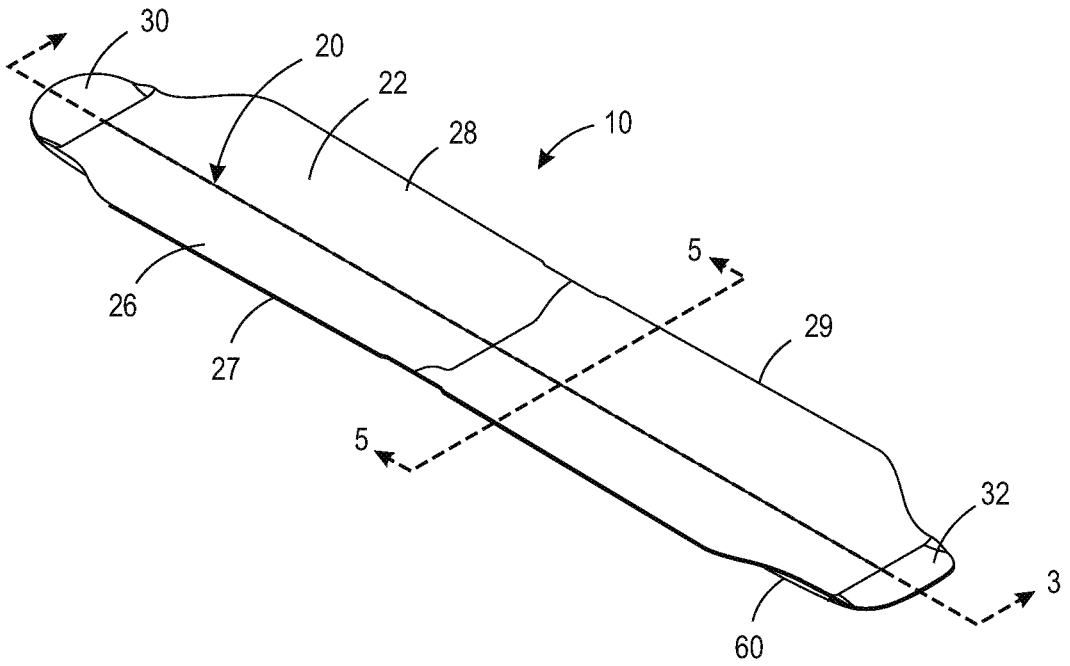
FIG. 1 is a top perspective view of an embodiment of a bindingless snowboard.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodologies, materials, and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices, or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be appreciated that "terrain park" is a ski slope or portion of a ski slope that includes features that skiers and snowboarders can do tricks on. "Back-country riding" is snowboarding where there is no resort or conventional groomed trails, while "racing" means riding through an area designated for competitive riding, e.g., slalom, giant slalom and downhill. "EVA foam" is closed cell, waterproof foam used on surfboards, while "VN foam" is closed cell, vinyl nitrile. "Grip tape" is an adhesive backed sandpaper like material used to increase friction on the upper surface of skateboards. "P-TEX®" is sintered high density polyethylene. "Bottom out" is when a side of a board hits the ground causing the edges to no longer be effective.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Figure 2:
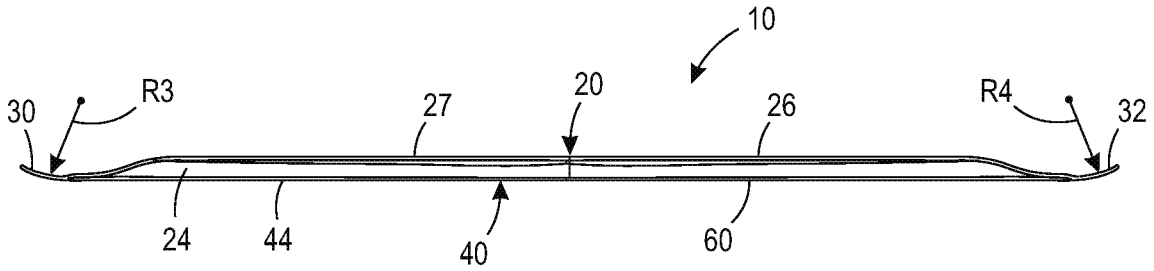
FIG. 2 is a side elevational view of the bindingless snowboard shown in FIG. 1.
Figure 3:
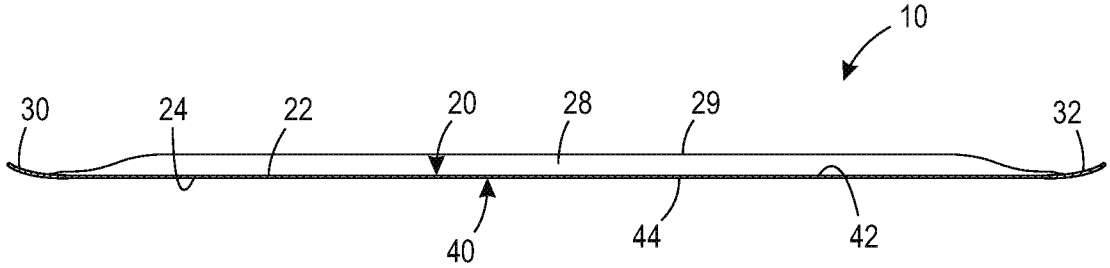
FIG. 3 is a cross-sectional view of the bindingless snowboard taken generally along line 3-3 in FIG. 1.
Figure 4:
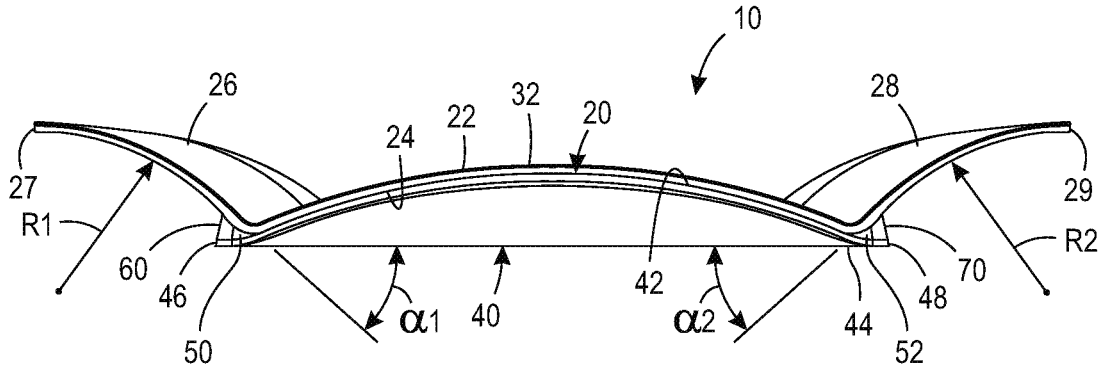
FIG. 4 is a front elevational view of the bindingless snowboard shown in FIG. 1.
Figure 5:
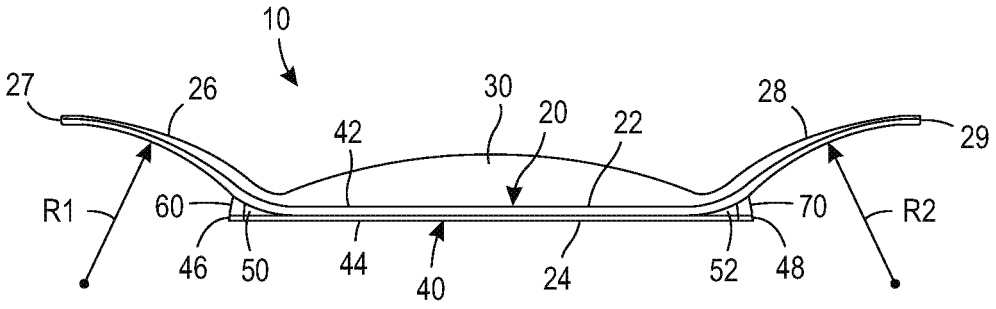
FIG. 5 is a cross-sectional view of the bindingless snowboard taken generally along line 5-5 in FIG. 1.

Referring now to the figures, FIG. 1 is a top perspective view of an embodiment of bindingless snowboard 10. FIG. 2 is a side elevational view of bindingless snowboard 10 as shown in FIG. 1. FIG. 3 is a cross-sectional view of bindingless snowboard 10 taken generally along line 3-3 in FIG. 1. FIG. 4 is a front elevational view of bindingless snowboard 10 as shown in FIG. 1. FIG. 5 is a cross-sectional view of bindingless snowboard 10 taken generally along line 5-5 in FIG. 1. Bindingless snowboard 10 broadly comprises core 20, base 40, sidewall 60, and sidewall 70. The following description should be viewed in view of FIGS. 1-5.

In some embodiments, core 20 comprises top surface 22, bottom surface 24, platform 26, platform 28, lip 30, and lip 32. Top surface 22 and bottom surface 24 are generally planar surfaces, with platforms 26 and 28, and lips 30 and 32 extending therefrom. Platform 26 extends from, for example, top surface 22 at angle $\alpha 1$ and comprises edge 27. In some embodiments, platform 26 comprises radius R1. In some embodiments, platform 26 is linear and does not comprise any curvature. Platform 28 extends from, for example, top surface 22 at angle $\alpha 2$ and comprises edge 29. In some embodiments, platform 28 comprises radius R2. In some embodiments, platform 28 is linear and does not comprise any curvature. Lip 30 extends from, for example, top surface 22. In some embodiments, lip 30 curves upward and comprises radius R3. Lip 32 extends from, for example, top surface 22. In some embodiments, lip 32 curves upward and comprises radius R4. In some embodiments, radius R3 is equal to radius R4. In some embodiments, radius R3 is greater than radius R4, while in some embodiments, radius R3 is less than radius R4.

Core 20 may comprise a single layer of material or a plurality of layers of material or materials. In some embodiments, core 20 comprises four layers of bamboo sandwiched between two layers of fiberglass and epoxy resin. Wood core construction is standard in traditional snowboards as it provides both flexibility and strength. Fiberglass and resin maintain a waterproof seal about the board which greatly increases longevity. In some embodiments, top surface 22 is lined with textured EVA foam. EVA foam provides waterproof grip and added comfort. In some embodiments, platforms 26 and 28 are lined with ultra-dense closed cell VN foam. VN foam provides better frictional grip than grip tape when wet and will not fill with snow thereby decreasing its grip. In some embodiments, edges 27 and 29 comprise steel. Steel edges are standard on snowboards and skis and provide excellent grip for carving turns, even in icy terrain. In some embodiments, elevated platforms 26 and 28 extend from top surface 22 to create a contour system having a valley or position for the rider's feet. The valley allows the rider to stay located in the ideal position on the board without fear of slipping off. In some embodiments, core 20 comprises a plurality of layers of birch held together with wood glue, and two bottom layers of bamboo. In some embodiments, platforms 26 and 28 comprise grip tape.

In some embodiments, base 40 comprises top surface 42, bottom surface 44, edge 46, and edge 48. Bottom surface 24 is secured to top surface 42. Top surface 42 and bottom surface 44 are substantially planar and comprise a greater linear dimension than bottom surface 24, i.e., extend on each side. This comprises a wedge-shaped space between edge 46 and platform 26, i.e., wedge 50, and between edge 48 and platform 28, i.e., wedge 52. Sidewall 60 is secured to the wedge-shaped space between edge 46 and platform 26. Sidewall 70 is secured to the wedge-shaped space between edge 48 and platform 28. In some embodiments, base 40 comprises P-TEX®. P-TEX® is typically formed by packing ultra high molecular weight polyethylene powder into a cake that is heated and compressed, i.e., sintered, to form a log or billet. Wax is often applied to P-TEX® to decrease friction and in promote sliding on snow and ice. In some embodiments, edges 46 and 48 comprise steel. As describe above, steel edges are standard on skis and snowboards, and provide excellent grip for carving turns, even on icy terrain. In some embodiments, sidewalls 60 and 70 comprise a plastic, such as acrylonitrile butadiene styrene (ABS).

Downward forces on platforms 26 and 28 cause the edges to engage the snow or ice and thereby causing bindingless snowboard 10 to turn. Generally, downward force on platform 26 causes edge 46 to engage the snow or ice, while downward force on platform 28 causes edge 48 to engage the snow or ice. Edges 27 and 29 are referred to as the outer edges, while edges 46 and 48 are referred to as the interior edges. Interior edges 46 and 48 are arranged elevationally lower than outer edges 27 and 29 and act as a first carving surface, i.e., first contact with the snow or ice for turning. However, if a rider leans harder for a more aggressive turn, interior edges 27 and 29 disengage from the snow or ice and outer edges 27 and 29 engage the snow or ice, thereby providing a second carving radius. It should be appreciated that as outer edges 27 and 29 are elevationally higher than interior edges 46 and 48, outer edges 27 and 29 are also elevationally higher than platforms 26 and 28. In view of the foregoing, it should be understood that snowboard 10 must be tilted at a first angle to engage interior edges 46 and 48 with the terrain and tilted at a second angle to engage outer edges 27 and 29, where the second angle is greater than the first angle.

It should be appreciated, that as angles $\alpha 1$ and $\alpha 2$ are increased, the responsiveness of bindingless snowboard 10 increases. In other terms, as $\alpha 1$ increases, turning becomes more sensitive, i.e., a rider can turn with less force applied to platform 26. Similarly, as $\alpha 2$ increases, turning becomes more sensitive, i.e., a rider can turn with less force applied to platform 28. Contrarily, as $\alpha 1$ decreases, turning becomes less sensitive, i.e., a rider must apply more force to platform 26 to turn. Similarly, as $\alpha 2$ decreases, turning becomes less sensitive, i.e., a rider must apply more force to platform 28 to turn. In some embodiments, angle $\alpha 1$ is equal to $\alpha 2$, while in some embodiments, angle $\alpha 1$ is greater than $\alpha 2$, and while in some embodiments, angle $\alpha 1$ is less than $\alpha 2$.

In some embodiments, the curvatures of platforms 26 and 28 influence the responsiveness of bindingless snowboard 10. For example, as radius R1 changes, turning may become more sensitive, i.e., a rider can turn with less force on platform 26. Similarly, as radius R2 changes, turning may become more sensitive, i.e., a rider can turn with less force on platform 28. In some embodiments, radius R1 is equal to radius R2, while in some embodiment, radius R1 is greater than radius R2, and in some embodiments, radius R1 is less than radius R2.

Figure 6:
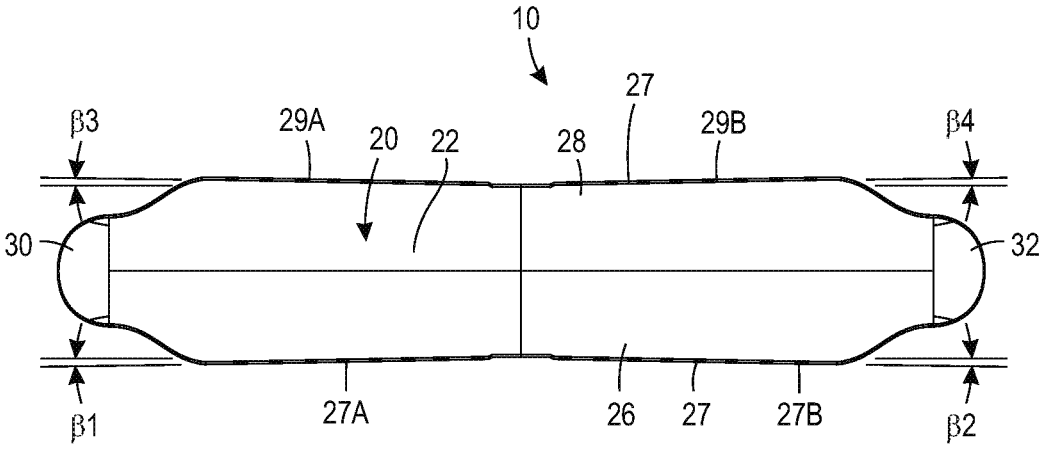
FIG. 6 is a top plan view of the bindingless snowboard shown in FIG. 1.
Figure 7:
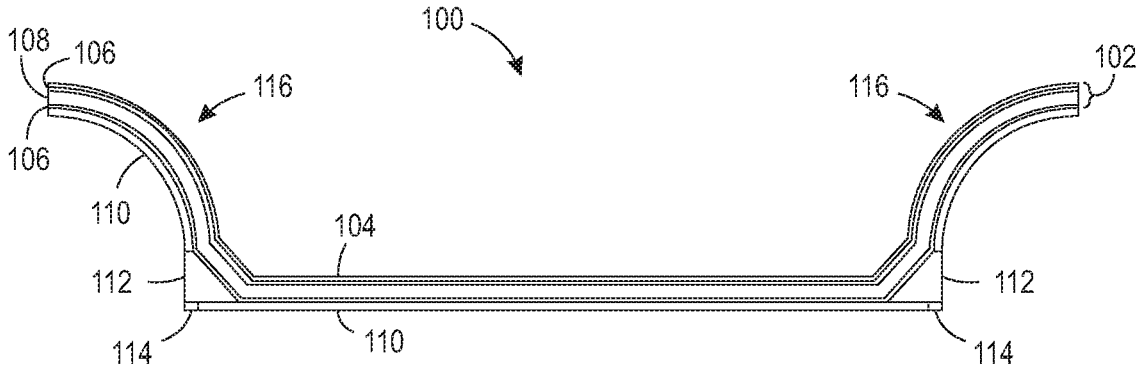
FIG. 7 is a cross-sectional view of an embodiment of a bindingless snowboard similar to the portion of a snowboard depicted in FIG. 3.
Figure 8:
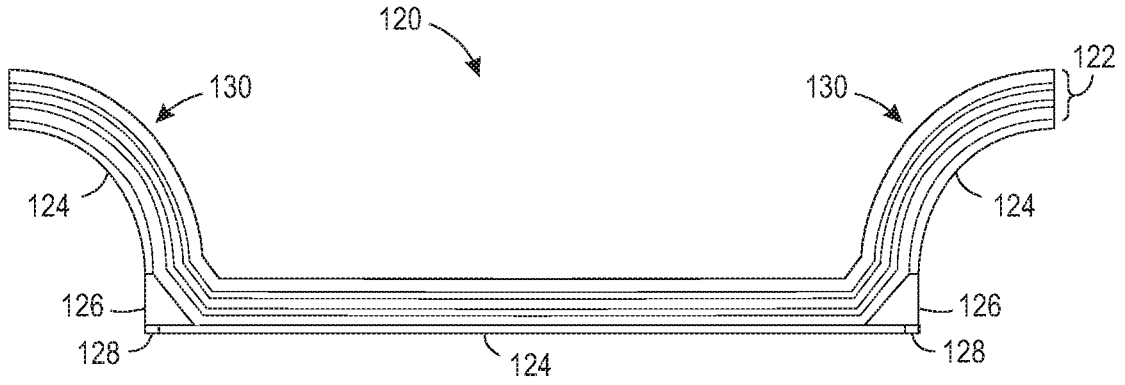
FIG. 8 is a cross-sectional view of an embodiment of a bindingless snowboard similar to the portion of a snowboard depicted in FIG. 3.
Figure 9:
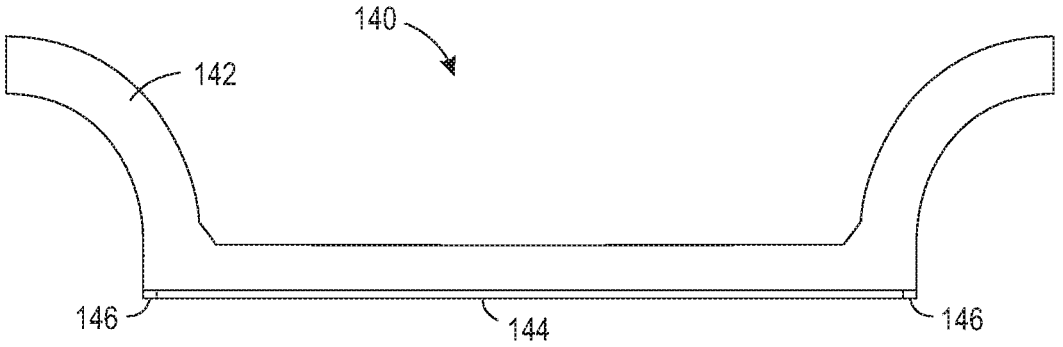
FIG. 9 is a cross-sectional view of an embodiment of a bindingless snowboard similar to the portion of a snowboard depicted in FIG. 3.

FIG. 6 is a top planar view of bindingless snowboard 10 as shown in FIG. 1. Edge 27 comprises portion 27A having angle $\beta 1$ and portion 27B having angle $\beta 2$. Edge 29 comprises portion 29A having angle $\beta 3$ and portion 29B having angle $\beta 4$. In some embodiments, edges 27 and 29 are not angled but rather are substantially linear. In other terms, angles $\beta 1$, $\beta 2$, $\beta 3$, and $\beta 4$ are each equal to 0 degrees. In some embodiments, edges 27 and 29 are each formed as continuous arcuate edges. In some embodiments, edges 27 and 29 are angled with angle $\beta 1$ equal to angle $\beta 2$ and angle $\beta 3$ equal to angle $\beta 4$. In some embodiments, edges 27 and 29 are angled with angle $\beta 1$ different than angle $\beta 2$ and angle $\beta 3$ different than angle $\beta 4$.

Various alternate embodiments for forming the presently disclosed bindingless snowboard have been contemplated and fall within the scope of the claims herebelow. Some alternate embodiments are depicted in FIGS. 7-11. For example, in some embodiments, snowboard 100 comprises multilayer structure 102. Multilayer structure 102 may include top sheet 104, composite 106, core 108, base 110, sidewall spacer 112 and carving edge 114. Top sheet 104 may be formed from various natural materials, e.g., wood, and/or various resin materials, e.g., nylon, ultra-high-molecular-weight polyethylene (UHMWPE and/or UHMW), etc. Composite 106 may be formed from various materials in combination with resin, e.g., fiberglass, carbon fiber with suitable binder, and/or other fabric materials in combination with epoxy resin. Core 108 may be formed from various natural materials, e.g., wood, various resin materials, e.g., foam, conventional plastics, etc., and/or metallic materials. The portions of top sheet 104, composite 106, and core 108 whereon a rider places her feet is collectively referred to as the deck. Base 110 may be formed from various natural materials, e.g., wood, various resin materials, e.g., UHMW, P-TEX®, etc., and/or metallic materials. Sidewall spacer 112 may be formed from various natural materials, e.g., wood, various resin materials, e.g., UHMW, P-TEX®, etc., and/or metallic materials. Edge 114 is typically constructed from metallic materials, e.g., steel, bronze, etc., although may also be constructed from alternate materials, e.g., ceramics. It should be appreciated that multilayer structure 102 may include greater or fewer numbers of layers than set forth above. For example, it is possible to achieve similar performance with base 110 being removed from wings/extensions 116. The foregoing would not affect performance as wings 116 are secondary sliding surfaces, although composite 106 and/or core 108 would be exposed to environmental conditions.

The placement of sidewall spacer 112 improves the functioning of the presently disclosed snowboard. Sidewall spacer 112 increases the transmission of force from a rider's foot, through the various layers to sidewall spacer 112 and subsequently to edge 114. The foregoing arrangement adds strength and rigidity to the overall structure, and more efficiently transmits forces to edge 114. Thus, for example, top sheet 104 composite 106, core 108, and base 110 may be permitted to flex as force is applied; however, sidewall spacer 112 does not flex and efficiently transmits force from the various layers to edge 114. Moreover, sidewall spacer 112 also facilitates creating the transition from a snowboard deck to the wings/extensions. Such transitions can be formed at angles less than ninety degrees, e.g., forty-five degrees, while sidewall spacer 112 is used to bridge the transition. Thus, for example, if the transition is thirty degrees, sidewall spacer 112 may be configured as a sixty degree insert to collectively form a ninety degree transition. This arrangement is particularly beneficial when forming the deck and extensions from materials that are difficult to introduce sharp transitions. Various configurations of multilayer structure 102 and sidewall spacer 112 are discussed below and are depicted in FIGS. 10A through 10I.

It should be appreciated that wings/extensions 116 function as levers while simultaneously providing a mechanism for securing a rider's feet to the presently disclosed snowboard. Thus, in some embodiments, extensions 116 may include a gripping material, e.g., grip tape, to further assist with securing a rider's feet. The upward rise of extensions 116 provides clearance for carving edges 114 while carving a turn, i.e., while the snowboard is tilted up on a single edge. Such an arrangement permits carving edges 114 to dig into the terrain without interference caused extensions 116 contacting the terrain. Moreover, extensions 116 add stiffness to the length of the presently disclosed snowboard. Thus, the core materials and/or other layers in multilayer structure 102 may be manufactured less rigid, i.e., at a reduced cost, as extensions 116 provide for added rigidity.

In some embodiments, multilayer structure 102 may be replaced with alternate materials. For example, snowboard 120 comprises plywood deck 122, base 124, sidewall spacer 126 and carving edge 128. In some embodiments, base 124 is included on the lower surface of wings/extensions 130, while in other embodiments, wings 130 do not include base 124. It should be appreciated that including base 124 on wings 130 adds an additional gliding surface that may be beneficial when riding in deeper snow or powder snow. Similarly, as described above, sidewall spacer 126 improves the transmission of forces from plywood deck 122 to edge 128. The foregoing structure can be formed from wood veneer layers bonded with adhesive to form a plywood board. Plywood deck 122 may be used in conjunction with composite layers and/or plastic layers as described above with respect to snowboard 100.

In some embodiments, multilayer structure 102 may be replaced with a monolithic molded structure. For example, snowboard 140 comprises molded core 142, base 144 and carving edge 146. It is believed that the contoured shapes of the various embodiments of the presently disclosed bindingless snowboard may be formed by a variety of plastic molding techniques. For example, molded core 142 may be formed by thermoforming or injection molding techniques, or alternatively by blown foam. Similar to snow board 120, snowboard 140 may be used in conjunction with composite layers and/or plastic layers as described above with respect to snowboard 100.

Various embodiments of multilayer 102 are herein described with reference to FIGS. 10A through 10I. In particular, various configurations of base 110, sidewall spacer 112 and edge 114 as well as various configurations of the outwardly projecting wing portions of multilayer structure 102 are described. It should be appreciated that for the sake of clarity, the base portion and edge have been depicted as a single structure; however, each embodiment depicted in FIGS. 10A through 10I includes an edge as one is desirable to facilitate carving turns. Therefore, reference to base portions in these figures should be understood to be reference to a base portion and edge collectively. Moreover, each of FIG. 10A through 10H includes a linear, compound linear or arcuate line to assist with understanding the various transitions described herebelow. Such transitions may include differences in the shape or orientation of the extensions, the sidewall spacers, and/or the angular relationship between the deck and the extensions.

Figure 10A:
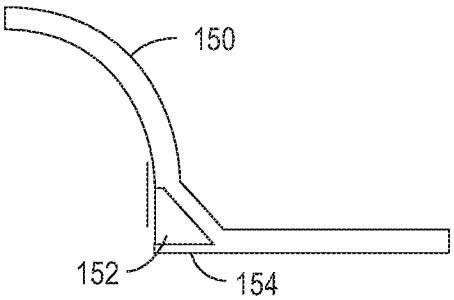
FIG. 10A is a partial cross-sectional view of an embodiment of an edge portion of a bindingless snowboard.

FIG. 10A depicts a flush transition between wing/extension 150, sidewall spacer 152 and base portion 154. This arrangement has been found to provide a balance between consistency and edge hold, i.e., the ability of an edge to grip the terrain during curving a turn. This embodiment is also easy to manufacture and maintain. It should be appreciated that the angle between wing 150, sidewall spacer 152 and base portion 154 does not necessarily have to be ninety degrees, e.g., it could be an angle lesser or greater than ninety degrees.

Figure 10B:
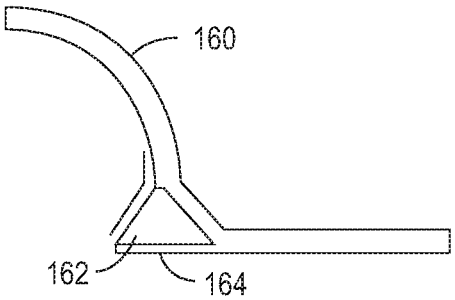
FIG. 10B is a partial cross-sectional view of an embodiment of an edge portion of a bindingless snowboard.

FIG. 10B depicts an angled-out transition between wing/extension 160, sidewall spacer 162 and base portion 164. This arrangement offers increased edge hold, with a less consistent feel to control.

Figure 10C:
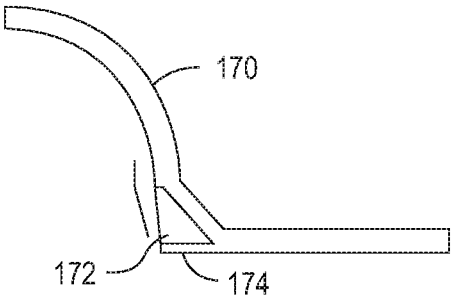
FIG. 10C is a partial cross-sectional view of an embodiment of an edge portion of a bindingless snowboard.

FIG. 10C depicts an angled-in transition between wing/extension 170, sidewall spacer 172 and base portion 174. This arrangement may be used to minimize overall base width while maintaining the benefit of transferring force from wing 170 to the edge associated with base portion 174.

Figure 10D:
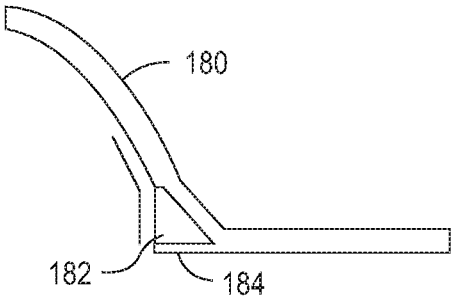
FIG. 10D is a partial cross-sectional view of an embodiment of an edge portion of a bindingless snowboard.

FIG. 10D depicts a wing angle variation between wing/extension 180, sidewall spacer 182 and base portion 184. This embodiment shows how altering the angle of the wing can affect the transition without the need to also change the sidewall spacer shape. Some reasons to consider altering the angle of the wing are discussed herebelow.

Figure 10E:
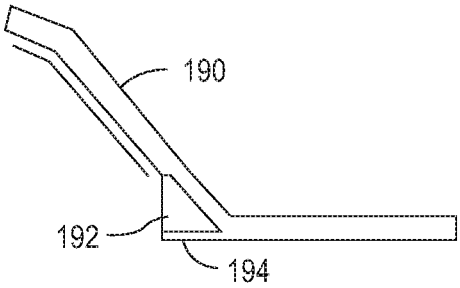
FIG. 10E is a partial cross-sectional view of an embodiment of an edge portion of a bindingless snowboard.

FIG. 10E depicts a wing profile variation between wing/extension 190, sidewall spacer 192 and base portion 194. This embodiment shows that the profile of wing 190 is not limited to arcuate forms. Thus, it is possible for wing 190 to be formed as a linear structure including an adjacent linear portion at a different angle arranged to receive a rider's foot.

Figure 10F:
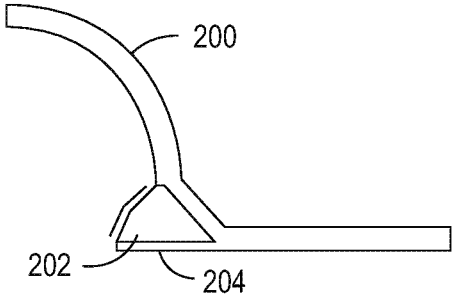
FIG. 10F is a partial cross-sectional view of an embodiment of an edge portion of a bindingless snowboard.

FIG. 10F depicts an angled profile between wing/extension 200, sidewall spacer 202 and base portion 204. This arrangement includes an outwardly protruding surface or an inwardly extending surface (not shown) on sidewall spacer 202. It is believed that this embodiment may provide increased edge control.

Figure 10G:
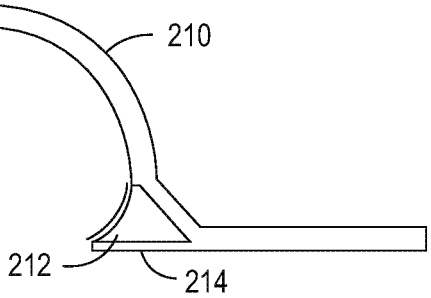
FIG. 10G is a partial cross-sectional view of an embodiment of an edge portion of a bindingless snowboard.

FIG. 10G depicts a curved profile between wing/extension 210, sidewall spacer 212 and base portion 214. This arrangement offers a smooth transition between the various portions of the snowboard.

Figure 10H:
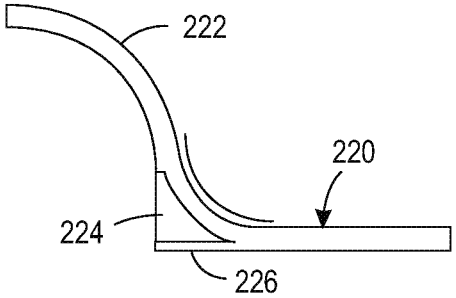
FIG. 10H is a partial cross-sectional view of an embodiment of an edge portion of a bindingless snowboard.

FIG. 10H depicts an interior profile of multilayer structure 220 having a conventional arrangement between wing/extension 222, sidewall spacer 224 and base portion 226. Embodiments described above included a forty-five degree angle between base portion 226 and wing 222, however, a wide variety of angles could be used, e.g., thirty degrees, sixty degrees, etc. Moreover, the inner surface could be arcuate as shown in FIG. 10H. This arrangement may offer manufacturing benefits as it may be easier to form a curved surface rather than a forty-five degree angle, i.e., it is easier to bend a wood core to an arcuate form as opposed to an abrupt angular change.

Figure 10I:
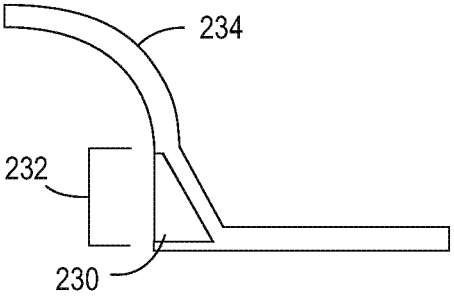
FIG. 10I is a partial cross-sectional view of an embodiment of an edge portion of a bindingless snowboard; and, FIG. 11 is a cross-sectional view of an embodiment of a bindingless snowboard similar to the portion of a snowboard depicted in FIG. 3.
Figure 11:
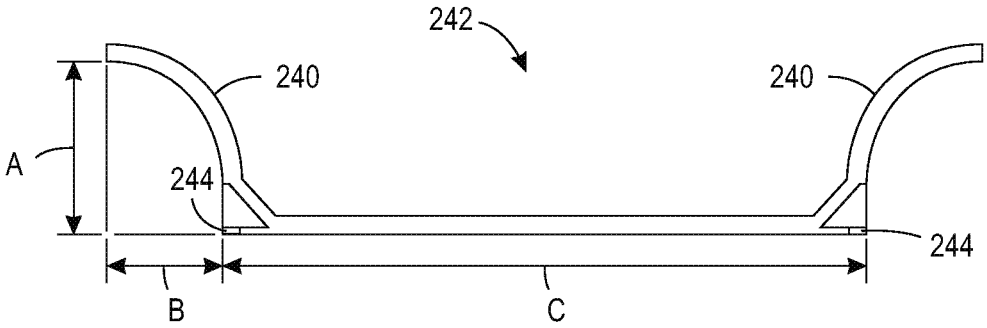

FIG. 10I depicts an increased height for sidewall spacer 230; however, it is also possible to decrease height 232 of sidewall spacer 230. This arrangement offers variability in the amount of clearance provided for wings/extensions 234, thereby affecting at what angle the snowboard may bottom out.

It should be appreciated that the presently disclosed bindingless snowboard may be arranged in various configurations. In addition to the variations described above, the height of wings/extensions 240, i.e., height A, the outward extension of wings 240, i.e., extension length B, and the width of the sliding portion of snowboard 242, i.e., base width C, may be varied depending on desired characteristics for the snowboard and the riding experience. The foregoing dimensions drive much of the performance characteristics of snowboard 242. Moreover, rider characteristics also drive board dimensions, e.g., rider foot size. Snowboard 242 may be offered in a number of sizes to accommodate various riders, e.g., small (Foot Size 4-7), medium (Foot Size 8-11) and large sizes (Foot Size 11+). The foregoing dimensions typically affect performance collectively. For example, base width C may be shortened for a rider with smaller feet while height A and extension length B remain constant thereby maintaining the performance of snowboard 242. Alternatively, maintaining height A while increasing extension length B and decreasing base width C affords greater leverage over carving edges 244 for riders having larger feet. However, such an arrangement is balanced against a decreased amount of surface area as a primary gliding surface and an increased chance of bottoming out while carving a turn. Furthermore, increasing height A while maintaining extension length B and base width C provides increased clearance when carving a turn which decreases the likelihood of bottoming out. However, such an arrangement is balanced against reducing a rider's feeling of being close to the ground and creating a larger board profile.

In view of the foregoing, it should be appreciated that the presently disclosed bindingless snowboard offers a variety of benefits not provided by conventional snowboard designs. Wings extending past the sidewalls and edges provide added leverage over the edges as well as helping keep a rider positioned on the board. The bindingless design helps reduce the overall weight of the snowboard and permits easier mobility about the terrain, e.g., a rider simply steps off the board and may then carry it. The presently disclosed snowboard includes a valley for positioning rider's feet which in turn increases controllability, leverage and grip. The sidewall spacers provide a direct connection between a rider and the snowboard edges. Moreover, the sidewall spacers facilitate positioning the edges inside of the outer edge, wherein the outer extensions are used to secure a rider's feet and provide surfaces for leveraging edges during carving. Furthermore, it should be appreciated that the presently disclosed bindingless snowboard is not limited by the shapes and configurations depicted in the figures. For example, some embodiments may include an upwardly turned portion at only the front end of the snowboard, or the snowboard may include camber as is conventional with skis and snowboards. Such variations fall within the scope of the claims recited herebelow. Additionally, some embodiments of the presently disclosed bindingless snowboard may include carving edges that are arcuate, parabolic, etc. in arrangement, i.e., include the arcuate, parabolic, etc arrangement of carving edges conventional for skis and snowboards.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Bindingless snowboard
20 Core
22 Top surface
24 Bottom surface
26 Platform
27 Edge
27A Portion
27B Portion
28 Platform
29 Edge
29A Portion
29B Portion
30 Lip
32 Lip
40 Base
42 Top surface
44 Bottom surface
46 Edge
48 Edge
50 Wedge
52 Wedge
60 Sidewall
70 Sidewall
100 Snowboard
102 Multilayer structure
104 Top sheet
106 Composite
108 Core
110 Base
112 Sidewall spacer
114 Carving edge
116 Wings/extensions
120 Snowboard
122 Plywood deck
124 Base
126 Sidewall spacer
128 Carving edge
130 Wings/extensions
140 Snowboard
142 Molded core
144 Base
146 Carving edge
150 Wing/extension
152 Sidewall spacer
154 Base portion
160 Wing/extension
162 Sidewall spacer
164 Base portion
170 Wing/extension
172 Sidewall spacer
174 Base portion
180 Wing/extension
182 Sidewall spacer
184 Base portion
190 Wing/extension
192 Sidewall spacer
194 Base portion
200 Wing/extension
202 Sidewall spacer
204 Base portion
210 Wing/extension
212 Sidewall spacer
214 Base portion
220 Multilayer structure
222 Wing/extension
224 Sidewall spacer
226 Base portion
230 Sidewall spacer
232 Height
234 Wings/extensions
240 Wings/extensions
242 Snowboard
244 Carving edges
$\alpha$1 Angle
$\alpha$1 Angle
$\beta$1 Angle
$\beta$2 Angle
$\beta$3 Angle
$\beta$4 Angle A Height
B Extension length
C Base width
R1 Radius
R2 Radius
R3 Radius
R4 Radius

What is claimed is:

1. A bindingless snowboard comprising:
a deck comprising a platform, the platform comprises a first deck side edge, a second deck side edge, an upper deck surface, and a lower deck surface;
a first extension secured to and extending from the first deck side edge;
a second extension secured to and extending from the second deck side edge;
a base comprising a top base surface, a bottom base surface, a first base side edge, and a second base side edge, the top base surface secured to the lower deck surface;
a first carving edge secured to the first base side edge;
a second carving edge secure to the second base side edge;
a first sidewall spacer:
secured between the first extension and the first carving edge;
positioned adjacent to the first deck side edge; and,
arranged on the top base surface; and,
a second sidewall spacer secured between the second extension and the second carving edge and positioned adjacent to the second deck side edge,
wherein:
at least one of the first extension and the second extension extends elevationally above the deck; and,
at least a portion of a first force applied to the first extension is transmitted to the first carving edge through the first sidewall spacer and at least a portion of a second force applied to the second extension is transmitted to the second carving edge through the second sidewall spacer.

2. The bindingless snowboard as recited in claim 1, wherein the deck comprises a multilayer structure.

3. The bindingless snowboard as recited in claim 1, wherein at least one of the first extension and the second extension comprises a multilayer structure.

4. The bindingless snowboard as recited in claim 1, wherein the deck, the first extension, and the second extension are formed as a continuous structure.

5. The bindingless snowboard as recited in claim 1, wherein at least one of the first extension and the second extension comprises an arcuate cross-sectional shape.

6. The bindingless snowboard as recited in claim 1, wherein at least one of the first extension and the second extension comprises a linear cross-sectional shape.

7. The bindingless snowboard as recited in claim 1, wherein at least one of the first extension and the second extension comprises a compound linear cross-sectional shape.

8. The bindingless snowboard as recited in claim 1, wherein the first extension comprises a first end adjacent to the first deck side edge and a second end opposite the first end, the second extension comprises a first end adjacent to the second deck side edge and a second end opposite the first end, the second end of the first extension comprises a third carving edge and the second end of the second extension comprises a fourth carving edge.

9. The bindingless snowboard as recited in claim 1, wherein the base extends beyond the first deck side edge and the second deck side edge.

10. The bindingless snowboard as recited in claim 9, wherein at least a portion of the base that extends beyond the first deck side edge is secured to the first sidewall spacer and the first edge and at least a portion of the base that extends beyond the second deck side edge is secured to the second sidewall spacer and the second edge.

11. The bindingless snowboard as recited in claim 1, wherein each of the first extension and the second extension comprises an extension base secured to a lower surface.

12. The bindingless snowboard as recited in claim 1, wherein a combination of the deck, the first extension, the second extension, the base, the first carving edge, and the second carving edge is less flexible due to the arrangement of the first sidewall spacer and the second sidewall spacer.

13. A bindingless snowboard comprising:
a deck comprising a platform, the platform comprises a first deck side edge, a second deck side edge, an upper deck surface, and a lower deck surface;
a first extension comprising a first end adjacent to the first deck side edge, a second end opposite the first end and a first carving edge secured to the second end, the first extension being secured to and extending elevationally upward from the first deck side edge;
a second extension comprising a first end adjacent to the second deck side edge, a second end opposite the first end and a second carving edge secured to the second end, the second extension being secured to and extending elevationally upward from the second deck side edge;
a base comprising a first base side edge and a second base side edge, the base secured to the lower deck surface;
a third carving edge secured to the first deck side edge; and,
a fourth carving edge secure to the second deck side edge,
wherein at least a portion of a first force applied to the first extension is transmitted to the first carving edge and at least a portion of a second force applied to the second extension is transmitted to the second carving edge.

14. The bindingless snowboard as recited in claim 13, further comprising:
a first sidewall spacer secured between the first extension and the first edge and positioned adjacent to the first deck side edge; and,
a second sidewall spacer secured between the second extension and the second edge and positioned adjacent to the second deck side edge,
wherein at least a portion of a first force applied to the first extension is transmitted to the first carving edge through the first sidewall spacer and at least a portion of a second force applied to the second extension is transmitted to the second carving edge through the second sidewall spacer.

15. A bindingless snowboard comprising:
a deck comprising a platform, the platform comprises a first deck side edge, a second deck side edge, an upper deck surface, and a lower deck surface;
a first extension secured to and extending from the first deck side edge;
a second extension secured to and extending from the second deck side edge;
a base comprising a top base surface, a bottom base surface, a first base side edge, and a second base side edge, the top base surface secured to the lower deck surface;

a first carving edge secured to the first base side edge;

a second carving edge secure to the second base side edge; and, a first sidewall spacer:

secured between the first extension and the first base side edge;

positioned adjacent to the first deck side edge; and, arranged on the top base surface;

wherein:

at least one of the first extension and the second extension extends elevationally above the upper deck surface; and, at least a portion of a first force applied to the first extension is transmitted to the first carving edge and at least a portion of a second force applied to the second extension is transmitted to the second carving edge.

16. The bindingless snowboard as recited in claim 15, further comprising:

a second sidewall spacer secured between the second extension and the second edge and positioned adjacent to the second deck side edge, wherein at least a portion of a first force applied to the first extension is transmitted to the first carving edge through the first sidewall spacer and at least a portion of a second force applied to the second extension is transmitted to the second carving edge through the second sidewall spacer.

17. The bindingless snowboard as recited in claim 15, wherein the first extension and the second extension extend elevationally above the upper deck surface.

18. The bindingless snowboard as recited in claim 15, further comprising:

a second sidewall spacer:

secured between the second extension and the second base side edge;

positioned adjacent to the second deck side edge; and, arranged on the top base surface.

* * * * *